US009441505B1

(12) United States Patent
Popp

(10) Patent No.: US 9,441,505 B1
(45) Date of Patent: Sep. 13, 2016

(54) ROLLER LIFTER WITH IMPROVED OIL INJECTION PORT AND SUPPLY GROOVE

(71) Applicant: David Charles Popp, Brooksville, FL (US)

(72) Inventor: David Charles Popp, Brooksville, FL (US)

(73) Assignee: Topline Automotive Engineering, Inc.

( * ) Notice: Subject to any disclaimer, the term of this patent is extended or adjusted under 35 U.S.C. 154(b) by 0 days.

(21) Appl. No.: 14/542,725

(22) Filed: Nov. 17, 2014

(51) Int. Cl.
*F01L 1/14* (2006.01)

(52) U.S. Cl.
CPC ..... *F01L 1/14* (2013.01)

(58) Field of Classification Search
CPC ..... F01L 1/14
USPC ..... 123/90.52
See application file for complete search history.

(56) References Cited

U.S. PATENT DOCUMENTS 4,708,102 A * 11/1987 Schmid ..... 123/90.35
7,748,359 B2 * 7/2010 Bartley et al. ..... 123/90.48

* cited by examiner

*Primary Examiner* — Zelalem Eshete
(74) *Attorney, Agent, or Firm* — Livingston Loeffler, P.A.; Edward M. Livingston, Esq.; Bryan L. Loeffler, Esq.

(57) ABSTRACT

A roller lifter (1) having an improved oil injection port (12) and oil supply groove (8) that is separated from an oil supply band area (7) and the engine oil supply gallery where debris commonly travels, thereby preventing the introduction of debris into the oil injection port and possible clogging of the oil injection port. The oil supply groove is angled to allow for oil to be easily collected by the oil supply groove.

15 Claims, 2 Drawing Sheets

ROLLER LIFTER WITH IMPROVED OIL INJECTION PORT AND SUPPLY GROOVE

FIELD OF THE INVENTION

This invention relates to roller lifters used in combustion engines and more specifically, a roller lifter having an improved oil injection port and supply groove that is separated from an oil band area, thereby preventing the introduction of debris into the oil injection port and possible clogging of the oil injection port.

BACKGROUND OF THE INVENTION

Internal combustion engines utilize valve lifters that operate in conjunction with cams of a camshaft to reciprocate valve lifters. Typically, as the camshaft rotates, the cams of the camshaft operatively engage an end of the valve lifter to reciprocate the valve lifters in an internal combustion engine. The valve lifters are located within cylindrical bores in an engine block. The engine block provides a travel passageway for each valve lifter and allows oil to lubricate each lifter assembly. Oil is directed to injection ports by a straight and common transverse oil passageway that intersects the injection ports.

Various valve lifter designs have been developed for specific engine environments. Hydraulic valve lifter assemblies and solid lifters are typically used for engines having relatively low revolutions per minute. Roller valve lifters (or roller lifters) utilize a roller to contact the cams of a camshaft and are typically used in engines having relatively high revolutions per minute. The use of a roller to contact the cams reduces wear and extends the useful life of both the valve lifter and the cams of the camshaft.

However, a problem commonly associated with valve lifters is the need to provide oil to the lifters as they reciprocate within the valve bores and to the valve lifter rollers and cams of the camshaft as the lifters ride on the cams. When using roller lifters, it is important to provide a sufficient supply of oil to the rollers and cams particularly at the point of contact. A known approach to increase the oiling of these areas is to provide an oil pressure feed groove or supply area on the surface of the roller lifter. This oil pressure feed groove is typically an annular groove or indented band on the circumference of the tappet body of the valve lifter. Oil enters the oil pressure feed groove from the common transverse oil passageway in the engine block that intersects the valve bores. As the roller lifter reciprocates within the engine, the oil pressure feed groove carries oil up and down the roller lifter bore and also directs oil towards the roller of the roller lifter that engages the cam. Although this method serves to provide some quantity of oil to the rollers and cams, in an engine having high revolutions per minute, there is a need to maximize the quantity of oil flowing to the rollers and cams to decrease roller and cam wear.

Another problem associated with engines having high revolutions per minute and using roller lifters is the need to supply adequate oil to the roller bearings of the roller lifter. Inadequate oiling of the roller bearing results in excessive wear and may lead to catastrophic failure of the bearing, and consequently failure of the entire engine. A known approach to oiling the roller bearings is to provide an oil supply port on or in an oil supply band area that receives oil directly from an engine oil supply gallery. Both of these areas are exposed to debris which is commonly found in the oil system. This debris can easily clog the oil supply port, thereby causing damage to the roller lifter and the engine.

Therefore, a need exists for a roller lifter having an improved oil injection port and supply groove that is located away from the oil supply band area and the engine oil supply gallery where debris commonly travels, thereby preventing the introduction of debris into the oil injection port and possible clogging of the oil injection port.

SUMMARY OF THE INVENTION

The primary object of the present invention is to provide a roller lifter having an improved oil injection port and supply groove that extends the life of the roller lifter by minimizing the wear and tear caused by debris entering into the oil injection port from the engine oil supply gallery.

The present invention fulfills the above and other objects by providing a roller lifter having an improved oil injection port and supply groove that is located away from the oil supply band area and the engine oil supply gallery where debris commonly travels, thereby preventing the introduction of debris into the oil injection port and possible clogging of the oil injection port. A scraping edge is located on the supply groove to scrape oil from walls of cylindrical bores in an engine block, thereby directing oil from the walls of the cylindrical bores into the supply groove and forcing the oil into the injection port.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
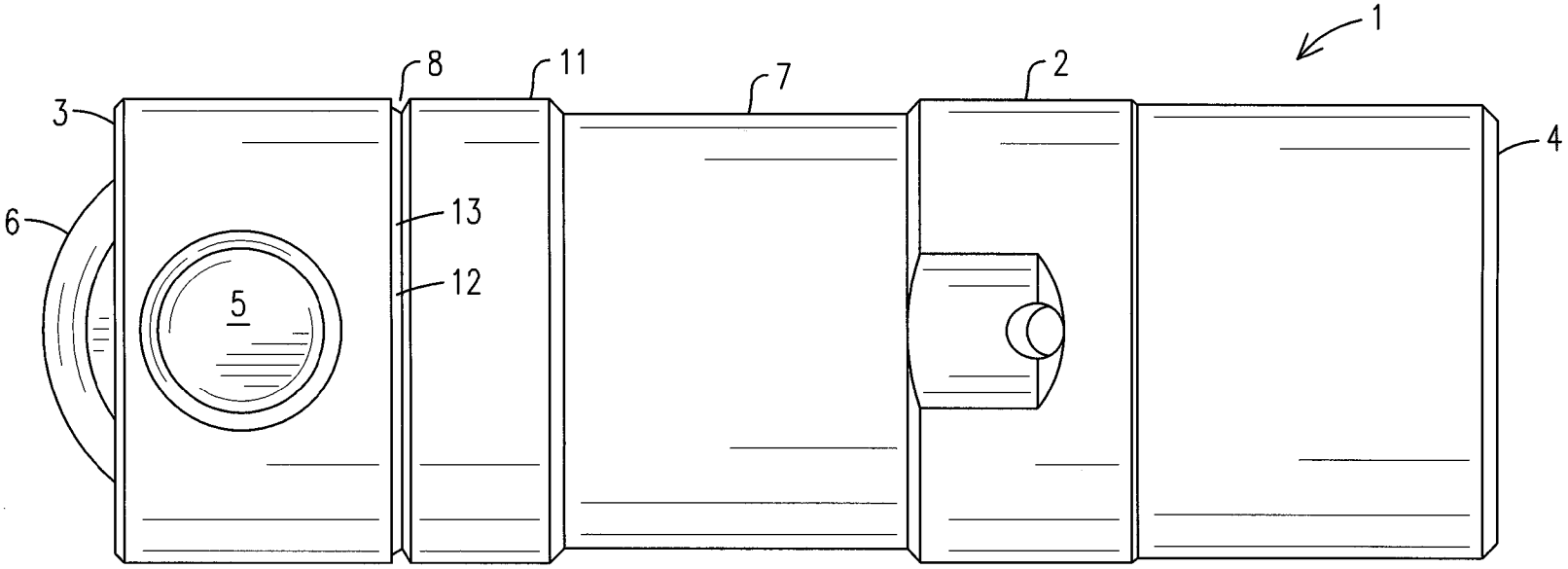
FIG. 1 is a top view of a roller lifter of the present invention having an improved oil injection port.
Figure 2:
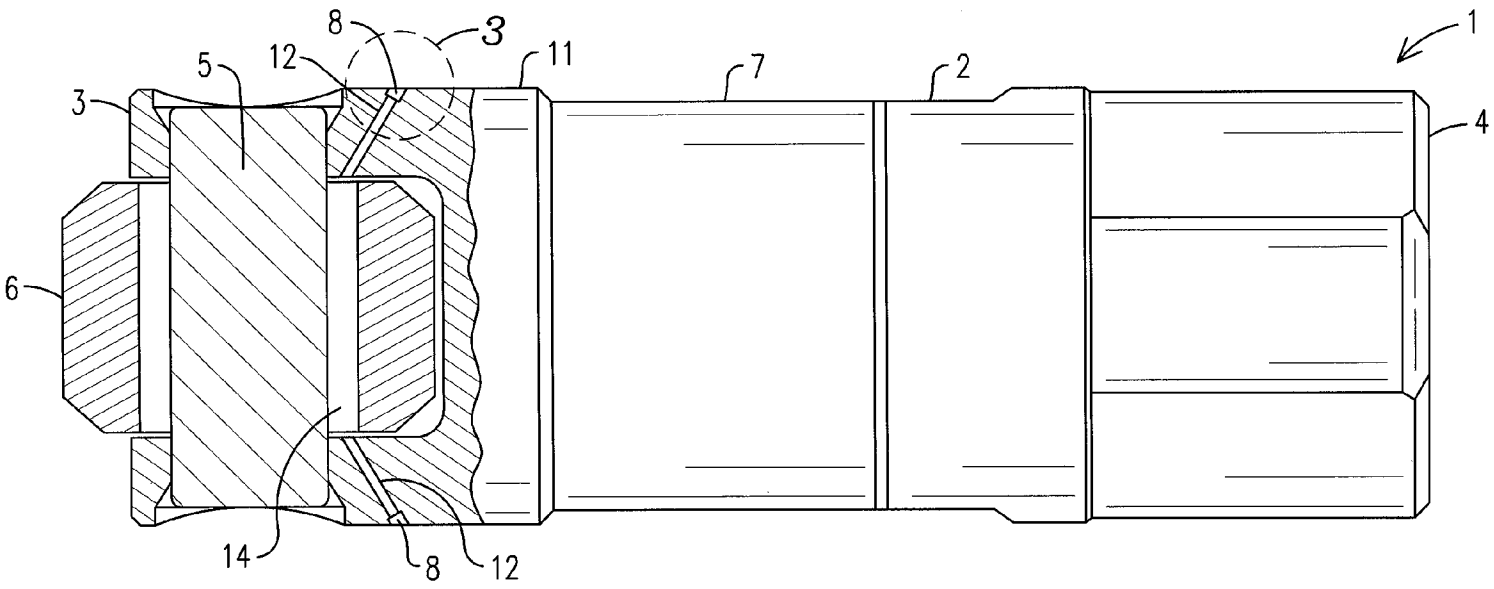
FIG. 2 is a partial cutaway side view of a roller lifter of the present invention having an improved oil injection port.
Figure 3:
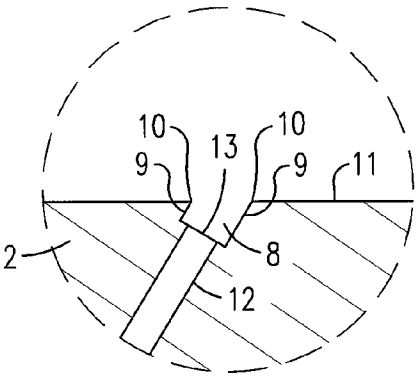
FIG. 3 is a view along line B of FIG. 2 of an improved oil injection port and oil supply groove having a scraper edge.

For purposes of describing the preferred embodiment, the terminology used in reference to the numbered accessories in the drawings is as follows:

1. roller lifter, generally
2. cylindrical body
3. first end of cylindrical body
4. second end of cylindrical body
5. axle
6. roller
7. oil supply band
8. oil supply groove
9. oil supply groove wall
10. upper edge of oil supply groove wall
11. outer surface of cylindrical body
12. oil injection port
13. interior surface of oil supply groove
14. interior space of roller lifter With reference to FIGS. 1 through 3, a perspective top view, a bottom view and a cross-sectional view along line 3-3 of FIG. 1, respectively, of a roller lifter 1 of the present invention are illustrated. The roller lifter 1 comprises a cylindrical body 2 having a first end 3 and a second end 4. The cylindrical body 2 houses an axle 5 and roller 6 located proximal to the first end 3 of the cylindrical body 2. An oil supply band 7 is preferably located between the first end 3 and second end 4 of the cylindrical body 2 and encompasses an outer circumference of the cylindrical body 2. At least one oil supply groove 8 is located proximate to the first end 3 of the cylindrical body 2 between the first end 3 and the oil supply band 7. The oil supply groove 8 preferably encompasses the entire outer circumference of the cylindrical body 2. The oil supply groove 8 is preferably substantially U-shaped and comprises two side walls 9 with upper edges 10, at least one of which is angled in a position that is greater than zero degrees and less than ninety degrees in relation to an outer surface 11 of the cylindrical body 2. This angle allows the upper edge 9 to scrape and direct oil into the oil supply groove 8.

One or more oil injection ports 12 are located on an interior surface 13 of the oil supply groove 8. The one or more oil injection ports 12 pass through the cylindrical body 2 to supply oil from the oil supply groove 3 to an interior space 14 of the roller lifter 1 and to the axle 5 and roller 6. The one or more oil injection ports 12 pass through the cylindrical body 2 at an angle that is equal or approximate to the angle of the oil supply groove 8 in relation to the outer surface 11 of the cylindrical body 2.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A roller lifter comprising:
a cylindrical body having a first end, a second end and an outer surface;
said cylindrical body having an outer circumference formed by an outermost surface of the cylindrical body;
at least one oil supply groove having two side walls with upper edges;
said at least one oil supply groove encompassing the outer circumference of the cylindrical body;
at least one of the side walls being angled in a position that is greater than zero degrees and less than ninety degrees in relation to the outer surface of the cylindrical body;
at least one oil injection port located on an interior surface of the oil supply groove; and
said two side walls of the at least one oil supply groove being parallel to each other and terminating at the outermost surface of the cylindrical body so that said upper edges of the two side walls are located on the outermost surface of the cylindrical body.

2. The roller lifter of claim 1 wherein:
said cylindrical body houses an axle and a roller located proximal to the first end of the cylindrical body.

3. The roller lifter of claim 1 further comprising:
an oil supply band located between the first end and second end of the cylindrical body.

4. The roller lifter of claim 1 wherein:
said oil supply groove is located proximal to the first end of the cylindrical body.

5. The roller lifter of claim 3 wherein:
said oil supply groove is located between the first end of the cylindrical body and the oil supply band.

6. The roller lifter of claim 1 wherein:
said oil supply groove is substantially U-shaped.

7. The roller lifter of claim 1 wherein:
the at least one oil injection port passes through the cylindrical body at an angle that is equal to the angle of the oil supply groove in relation to the outer surface of the cylindrical body.

8. A roller lifter comprising:
a cylindrical body having a first end, a second end and an outer surface;
said cylindrical body having an outer circumference formed by an outermost surface of the cylindrical body;
at least one oil supply groove having two side walls with upper edges;
said at least one oil supply groove encompassing the outer circumference of the cylindrical body;
the side walls each being angled in a position that is greater than zero degrees and less than ninety degrees in relation to the outer surface of the cylindrical body;
at least one oil injection port located on an interior surface of the oil supply groove;
the at least one oil injection port passes through the cylindrical body at an angle that is equal to the angle of the oil supply groove in relation to the outer surface of the cylindrical body; and
said two side walls of the at least one oil supply groove being parallel to each other and terminating at the outermost surface of the cylindrical body so that said upper edges of the two side walls are located on the outermost surface of the cylindrical body.

9. The roller lifter of claim 8 wherein:
said cylindrical body houses an axle and a roller located proximal to the first end of the cylindrical body.

10. The roller lifter of claim 8 further comprising:
an oil supply band located between the first end and second end of the cylindrical body.

11. The roller lifter of claim 8 wherein:
said oil supply groove is located proximal to the first end of the cylindrical body.

12. The roller lifter of claim 10 wherein:
said oil supply groove is located between the first end of the cylindrical body and the oil supply band.

13. The roller lifter of claim 8 wherein:
said oil supply groove is substantially U-shaped.

14. The roller lifter of claim 8 wherein:
the at least one oil injection port passes through the cylindrical body at an angle that is equal to the angle of the oil supply groove in relation to the outer surface of the cylindrical body.

15. A roller lifter comprising:
a cylindrical body having a first end, a second end, an outer surface and an interior space;
said cylindrical body having an outer circumference formed by an outermost surface of the cylindrical body;
at least one oil supply groove having two side walls with upper edges;
said at least one oil supply groove encompassing the outer circumference of the cylindrical body;
the side walls each being angled in a position that is greater than zero degrees and less than ninety degrees in relation to the outer surface of the cylindrical body;
at least one oil injection port located on an interior surface of the oil supply groove;

the at least one oil injection port passes through the cylindrical body at an angle that is equal to the angle of the oil supply groove in relation to the outer surface of the cylindrical body;

said two side walls of the at least one oil supply groove being parallel to each other and terminating at the outermost surface of the cylindrical body so that said upper edges of the two side walls are located on the outermost surface of the cylindrical body; and said at least one oil injection port directly connects the oil supply groove to the interior space.

* * * * *